United States Patent [19]

Weismann

[11] 4,218,045

[45] Aug. 19, 1980

[54] MOBILE HEAVY LIFT MECHANISM

[76] Inventor: Victor P. Weismann, 430 Prospect Cir., South Pasadena, Calif. 91030

[21] Appl. No.: 925,032

[22] Filed: Jul. 17, 1978

[51] Int. Cl.[2] ..... B66C 23/60

[52] U.S. Cl. ..... 254/323; 212/265

[58] Field of Search ..... 254/139.1, 139, 144; 214/390, 392; 52/117, 118, 115, 632, 145, 146, 152; 248/163, 165, 169, 171, 168, 170; 414/541, 542; 212/8 R

[56] References Cited

U.S. PATENT DOCUMENTS

| | | | |
|---|---|---|---|
| 2,421,913 | 6/1947 | Stoddard | 52/117 |
| 2,597,958 | 5/1952 | Slater | 52/118 |
| 3,140,857 | 7/1964 | Nickles | 254/139.1 |
| 3,263,232 | 7/1966 | Burwell et al. | 52/117 |

*Primary Examiner*—Kenneth W. Noland
*Attorney, Agent, or Firm*—Christie, Parker & Hale

[57] ABSTRACT

A mechanism, useful in rough terrain for lifting and moving heavy loads short distances, resembles a tripod. The mechanism has three leg assemblies which are variable in length under control of an operator while subjected to axial loading. The legs are pivotally connected at their upper ends to a common crown block assembly and at each of their lower ends to a self-propelled base unit. A power source is associated with each leg assembly for varying the length of the associated leg assembly under axial loading. A winch is associated with one of the legs for reeling in and out a cable extending from the winch and via the crown block to a load. The mechanism is disassemblable for transport to a site of use. In its assembled state, the base units are disposed in spaced relation about a load and the legs are adjusted so that the crown block assembly is disposed over the load. After the load has been picked up, it is moved laterally within an area bounded by the base units by variation in the length of the variable-length leg assemblies.

19 Claims, 4 Drawing Figures

MOBILE HEAVY LIFT MECHANISM

BACKGROUND OF THE INVENTION

1. Field of the Invention

This invention pertains to the handling of heavy loads. More particularly, it pertains to the lifting and movement of heavy loads through the use of a tripod-like structure in which a lateral movement of the load is accomplished by variation in the lengths of the legs of the structure to cause their common connection point, from which the load is suspended, to move laterally without movement of the locations of the lower ends of the legs.

2. Review of the Prior Art

Most large pipeline projects, such as Bureau of Reclamation siphons, pumplines and gravity flow lines, are in rough terrain locations such as steep hillsides. The necessary pipelaying equipment must adapt to these conditions without having to grade excessive roadways, rights of way or operation areas.

In most such pipeline projects, the pipeline itself is defined by sections of concrete pipe, which sections may have an overall diameter of 25 feet or more. It is therefore apparent that the rough terrain environments through which such pipelines are laid impose considerable problems upon transport of the individual pipeline sections to the pipeline right of way which, typically, is a trench. Also, the equipment needed to move individual pipeline sections from adjacent the trench into the trench are massive and expensive; they are also difficult to move to the work site unless substantial roadways and access paths are provided to the trench and therealong.

A need exists for improved equipment for handling heavy loads in remote locations, such as large diameter pipeline sections in rough terrain. Ideally, equipment for this purpose should be transportable to the location of use on vehicles which do not require excessively wide roadways. Such equipment should also be able to function at the work site along a right of way of minimum width.

SUMMARY OF THE INVENTION

This invention addresses the need identified above. It provides simple, effective and efficient equipment and procedures which are especially useful in lifting and moving heavy loads over short distances. The equipment is particularly useful in rough terrain. The equipment is capable of disassembly into component parts of modest scale which are transportable by conventional vehicles to the location of use where the equipment is readily assembled and made ready for use.

Generally speaking, in terms of apparatus, this invention provides a load lifting and moving arrangement which includes at least two, preferably three, leg assemblies. At least one of the leg assemblies is arranged for controlled variation of the length thereof while subjected to axial loading. Power means are associated with each variable-length leg assembly and are selectively operable for varying the length of the associated leg assembly under axial load conditions. A base unit is provided for each leg assembly. Each base unit includes means cooperable with a lower end of a leg assembly for pivotally connecting the leg assembly to the unit. A crown block assembly includes means cooperable with an upper end of each of the leg assemblies for pivotally interconnecting the leg assemblies at the crown block assembly. Winch means are associated with one of the base units. The winch means is operable for reeling in and out a cable which is extendable therefrom via the crown block assembly to a load for lifting and lowering the load in an assembled state of the apparatus.

When the apparatus is in its assembled state, the leg assemblies are pivotally connected between the base units and the crown block assembly. The base units are disposed in spaced relation about the location of the load in such a manner as to encompass the location at which the load is to be picked up and also the location to which the load is to be moved and deposited. The variable-length leg assemblies are operated to position the crown block assembly substantially over the pick up location of the load. Once the load has been picked up, it is moved by variation of the length of the variable-length leg assemblies to produce lateral movement of the crown block assembly below which the lifted load is suspended.

DESCRIPTION OF THE DRAWINGS

The above-mentioned and other features of this invention are more fully set forth in the following detailed description of presently preferred embodiments of the invention, which description is presented with reference to the accompanying drawings, wherein.

DESCRIPTION OF THE ILLUSTRATED EMBODIMENTS

Figure 1:
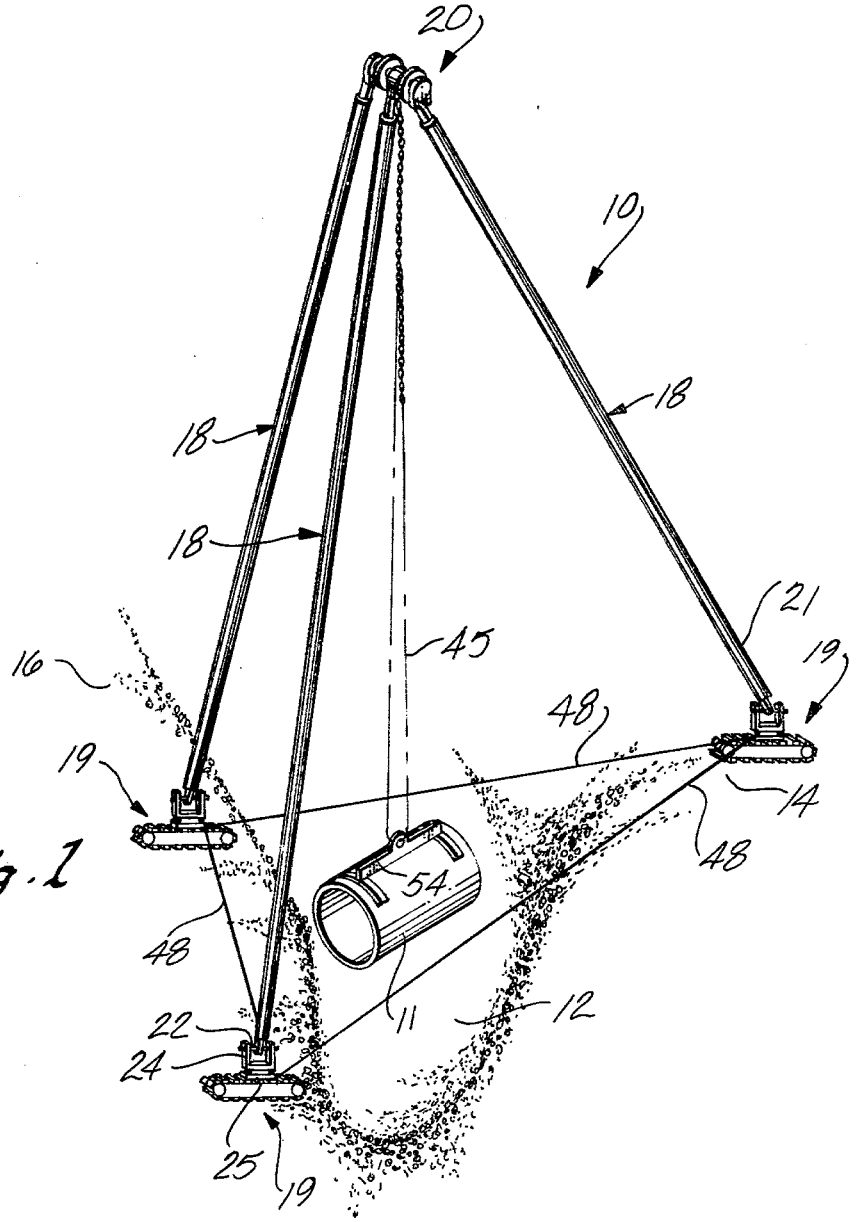
FIG. 1 is a simplified perspective view of the present heavy lift equipment in use.
Figure 2:
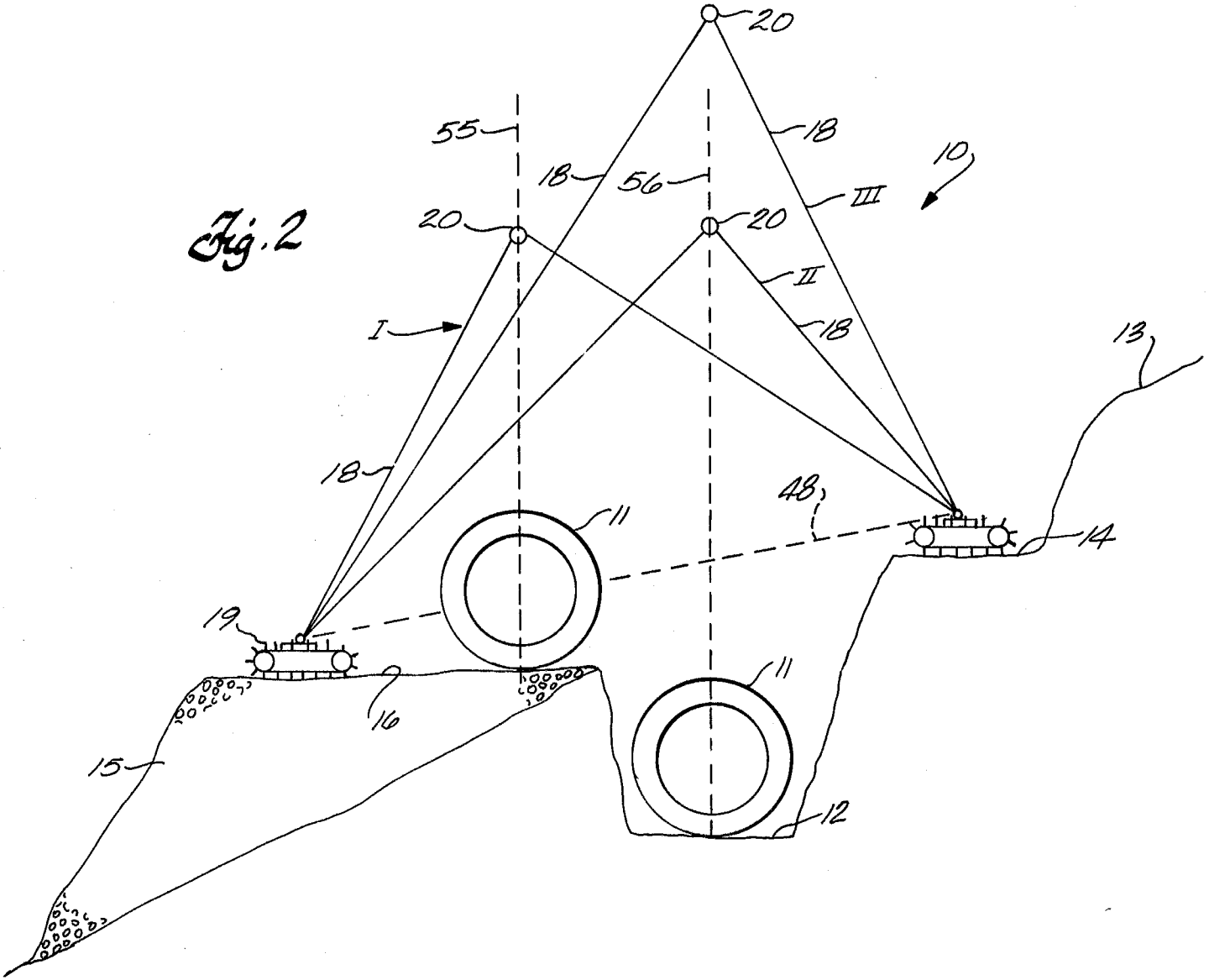
FIG. 2 is a schematic elevation view depicting the operation of the apparatus.

A heavy-lift rough-terrain mobile 10, comprising apparatus according to this invention, is shown in the accompanying drawings. In FIGS. 1 and 2, an exemplary use of the mobile is illustrated. This use is in connection with the construction of a large diameter pipeline, such as an aqueduct, in which individual pipe sections 11 are to be placed in a trench 12. To illustrate the utility of this invention, the trench is shown in FIG. 2 as traversing the side of a hill 13. The pipeline sections can be made of concrete and can have a diameter of 25 feet or greater. Obviously, pipeline sections of such scale are massive and present difficulties in the movement to the pipeline right of way, and difficulties in the placement of the sections as delivered alongside trench 12 into place in the trench. It is the latter difficulties which are addressed by mobile 10.

The cross-section view of FIG. 2 illustrates typical practice in the construction and formation of a pipeline trench across a hillside. A relatively narrow terrace 14 is formed parallel to trench 12 on the uphill side of the trench. Earth removed from the hillside to define trench 12 and terrace 14 is disposed downhill of the trench as a spoilbank 15 having a generally horizontally upper surface 16 which extends to the downhill edge of the trench. The trench, terrace 14 and spoilbank 15 define the right of way of the pipeline during its construction stage. After laying of the pipeline, the material of the spoilbank is returned to the trench and, at least in part, to the volume removed from the hillside to define terrace 14. In view of the volume occupied in trench 12 by the finished pipeline, a minor portion of the spoil-bank remains parallel to the pipeline to provide a maintenance access road.

Individual lengths 11 of the pipeline are delivered alongside trench 12 by suitable vehicles which are not a part of this invention. For the purposes of this invention, it is assumed that the individual sections 11 are suitably disposed alongside the trench for subsequent handling by mobile 10.

Mobile 10 is a disassemblable construction which includes three elongate load-carrying leg assemblies 18, a self-propelled base unit 19 for each leg assembly, and a crown block assembly 20 which is common to the three leg assemblies; note, however, the following remarks concerning two-leg or four-leg constructions according to this invention. Each of the leg assemblies preferably is arranged for controlled variation of the length thereof while the leg assembly is subjected to substantial axial loading. Variability in the length of each leg assembly is of a double-acting nature in that the leg can be elongated or shortened under load.

The lower end 21 of each leg assembly is pivotally connected to a respective base unit 19. Preferably, this coupling is of a universal nature so that the leg can assume any attitude desired relative to its base unit. Thus, as shown in FIG. 1, the lower end of each leg assembly is pinned, as by a pin 22 about which the lower end of the leg assembly is rotatable, to the upper ends of the arms of a bifurcated, upwardly open yoke 24. The yoke is, in turn, mounted for rotation about a vertical axis to a foundation 25 carried by the base unit. The connection shown in FIG. 1 of the leg assemblies to the base units will be understood, however, to be merely an exemplary coupling; it will similarly be understood that any coupling structure capable of permitting the leg assembly to rotate about its axis relative to the base unit and to pivot relative to the base unit may be used as appropriate. Thus, in FIG. 3, a ball and socket style of leg-base connection is shown.

Figure 3:
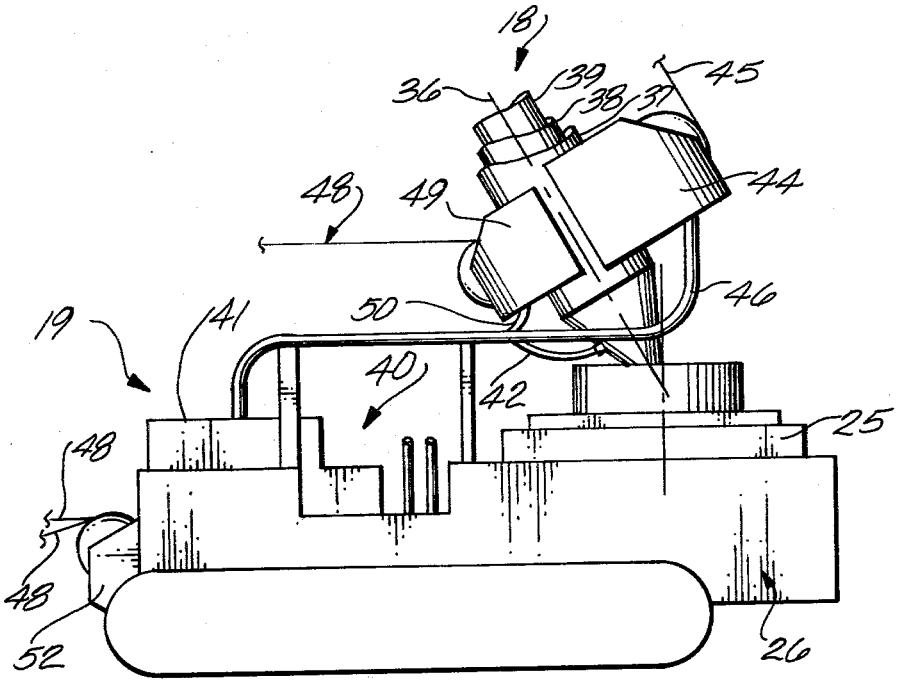
FIG. 3 is a fragmentary side elevation view of another form of self-propelled leg base unit and an adjacent portion of a variable-length leg assembly.

Each base unit preferably is provided as a self-propelled, steerable track-laying mechanism. Thus, the base units may be defined by track-laying crawler units of the type which have been used for many years in large earth moving and construction equipment, or, as shown in FIG. 3, as a track-laying, crawler tractor 26 of the type which serves as a principal component in bulldozers, for example. The base units each include a pair of track loops which can be driven together or separately. The base units are steerable by differential operation of their track loops.

Figure 4:
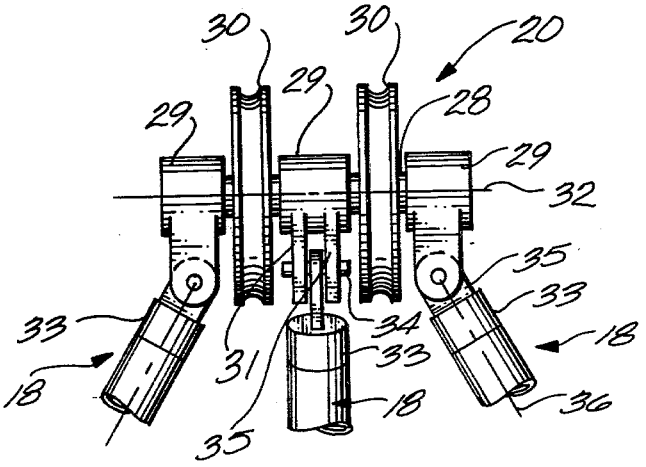
FIG. 4 is a fragmentary elevation view of the interconnection between the upper ends of the leg assemblies.

Crown block assembly 20, shown in FIG. 4, includes a shaft 28 to which are rotatably mounted three bearing blocks 29, one at each of the ends of the shaft and one intermediate its length. Two wire rope sheaves 30 are also rotatably mounted on shaft 28 between the bearing blocks. Preferably, the central bearing block is located between the sheaves. A pair of spaced parallel lugs 31 extend from the exterior of each bearing block in the same direction away from the axis 32 of shaft 28. Each bearing block is coupled, preferably in a releasable manner, to the upper end 33 of a corresponding leg assembly 18. This coupling can be made by a pin 34 which extends between each of lugs 31 parallel to shaft axis 32, and which cooperates with a suitable opening formed through the upper end of a lug 35 disposed between lugs 31 and secured to the upper end of the adjacent leg assembly. It will be seen, therefore, that the axis 36 of each leg assembly can assume any attitude necessary relative to axis 32 during use of the mobile; in this connection, it will be recalled that the lower end of each leg assembly is also movably connected to the corresponding base unit.

As noted above, it is preferred that each leg assembly 18 will be variable in length at times when the leg assembly is subjected to an axial load. Preferably, as shown in FIG. 3, each leg assembly includes a multi-stage hydraulic ram composed of concentric cylinders 37, 38 and 39, for example, coaxially aligned with leg axis 36. Each leg assembly, therefore, can be variable in extent between a minimum length of about 50 feet and a fully extended length of about 120 feet, for example. In the embodiment of the invention shown in FIG. 3, in which each base unit 19 is defined by a dual-track crawler tractor 26 which includes an operator's station 40, hydraulic power for operating the ram aspect of leg assembly 18 is derived from a hydraulic power supply module 41 via a suitable hydraulic line 42. The ram, of which cylinders 37, 38, and 39 are components, can be operated for shortening and for extending the length of the leg assembly under load under control of an operator at station 40.

One of the leg assemblies has associated with it a winch 44 for reeling in and out a cable 45 which extends from the winch, in the assembled state of the mobile, via sheaves 30 of crown block assembly 20 to a load to be picked up, such as pipe section 11 as shown in FIG. 1. Winch 44 is shown in FIG. 3 mounted to the lower end of a leg assembly for movement with the leg assembly relative to the base unit during operation of the mobile. The winch preferably is hydraulically powered and is coupled by a suitable hydraulic line 46 to hydraulic power module 41.

During the course of picking up, moving, and depositing any given load by mobile 10, the base units 19 are maintained in predetermined locations which define the points of a triangular area which encompasses both the location at which the load is to be picked up and the location at which the load is to be deposited. As will be apparent from the following description, during handling of the load the weight of the load is borne by the leg assemblies which, by reason of their connection to the common crown block assembly, are not disposed vertically. Therefore, some lateral loads will be applied to each of the base units in such a manner as to induce the base units to move away from each other. To retain the base units in the positions established at the time a load is picked up, flexible inelastic tension members are interconnected between the base units to prevent the base units from moving apart under these lateral loads. The flexible inelastic tension members preferably are wire rope cables 48 connected from each base unit to the other two base units. FIG. 3 illustrates two alternative arrangements for coupling these cables between the base units.

As shown in FIG. 3, a hydraulic winch 49 can be mounted to the lower end of each leg assembly for movement with the leg assembly relative to the base unit for reeling in and out a corresponding one of three inter-base stabilizing cables 48. Power for operating each winch 49 is derived from the hydraulic power module 41 on the adjacent base unit via a suitable flexible hydraulic line 50. Alternatively, as shown in FIG. 3, each base unit can carry directly thereon a winch 52 to which at least one of cables 48 is connected for reeling in and out that cable.

Regardless of which arrangement is used, the end of the cable not connected to a corresponding winch is arranged for releasable connection either to a coupling point on another leg assembly, or to a coupling point on one of the other base units.

It is apparent that each of stabilizing cables 48 is effectively variable in length by appropriate operation of the winch to which the cable is connected.

In the exemplary application of mobile 10 shown in FIGS. 1 and 2, the mobile preferably is assembled so that two base units 19 are disposed on spoilbank surface 16 on the downhill side of trench 12 and one of the base units is located on terrace 14 on the uphill side of the trench. The base units are positioned as described above, i.e., at the points of a triangular area within which lie both the location from which the load is to be picked up and the location at which the load is to be deposited. Cable 45 is rigged via the crown block assembly and to the load, i.e., pipe section 11, either directly or via a lifting cradle 54, shown in FIG. 1. Preferably the rigging of cable 45 between the crown block assembly and the load is a multi-part arrangement to provide a mechanical advantage greater than unity. Once the base units have been driven into the desired positions and aligned in the appropriate manner relative to each other, stabilizing cables 48 are connected between the base units and are tensioned. The lengths of the leg assemblies are then adjusted to cause the crown block assembly to be positioned substantially directly over the pickup location of the load; this condition is shown as I in the schematic representation in FIG. 2 wherein crown block assembly 20 is disposed on line 55 which passes vertically through the crown block assembly and through the center of pipe section 11 as disposed at its pickup location on spoilbank surface 16. Winch 44 is then operated to cause the load to be lifted from its pickup location and suspended via hoist cable 45 from the crown block assembly. Then, without movement of the position of base units 19, the lengths of leg assemblies 18 are adjusted to cause the crown block assembly to move laterally into a position substantially directly over the set down or deposit location of the load which, in the instance of the exemplary usage of FIG. 2, is over trench 12. This condition of the mobile is represented in FIG. 2 by II in which the crown block assembly is positioned on line 56 which passes vertically through the crown block assembly and the set down position of pipe section 11 in trench 12. Hoist cable 45 is then paid out from winch 44 to cause the pipe section to be lowered into the desired position in trench 12.

FIG. 3 illustrates a third operative state III of the geometry of the mobile in use; in this state, crown block assembly 20 is located on line 56 at a position higher than the position of the crown block assembly in state II of the mobile. It is therefore apparent that the mobile can be operated to assume any geometry desired or appropriate within the range of variation of length of the several leg assemblies as may be desired, or required by the specific circumstances of any lift-and-move situation.

Once the pipe section 11 has been set down in trench 12 and the hoist cable has been disconnected from the pipe section, the stabilizing cables between the base units are slacked or disconnected, and the base units are self-propelled into a new relative position along the line of trench 12. This is done to position the mobile for pickup and movement of the next pipe section to be placed in trench 12. Such movement of the mobile is facilitated by the steerable self-propelled nature of the base units. The fact that the surfaces of terrace 14 and spoilbank 15 may not be parallel to each other, or even level, presents no great difficulty in moving the mobile into position for a given lift-and-move operation, or from the situs of one operation to the next, in view of the independent mobility of each base unit, and in view of the movable connection of each leg assembly both to the crown block assembly and the respective base units.

If desired, the movement of the several base units, the operation of winches 49 or 52, and the operation of winch 44 can be controlled from a central control location associated with one of the base assemblies, preferably the base unit associated with winch 44.

It will be understood that the sizing and load-carrying capacity of the components of mobile 10 will be determined by the maximum load which a mobile will be required to handle in use, and by the maximum included angle which each leg assembly can be expected to assume in use relative to a vertical line through the crown block assembly.

Those familiar with the art and technology to which this invention pertains will readily appreciate that the benefits and advances of this invention may be obtained in an arrangement in which only a single leg assembly has the capability for variation of the length thereof under axial loading of the leg assembly. It is preferred, however, that each leg assembly have a variable-length capability under load to provide maximum flexibility and utility of the overall mobile. If only a single leg assembly has variable-length capability, it is suggested that the variable-length leg assembly be associated with the base unit disposed on the uphill side of trench 12 in applications of the mobile like or similar to the application illustrated in FIGS. 1 and 2.

It will also be apparent that a mobile according to this invention can have three or more leg assemblies, at least one of which is of variable-length capability. Three leg assemblies, each of variable-length capability, are preferred. The presence of four or more leg assemblies in a heavy lift mobile complicates the positioning and lateral movement operations.

Similarly, a two-leg arrangement, having a single extensible leg, can be used to obtain the benefits of this invention. For example, the single fixed length boom or leg of a side-lift tractor can be assisted by a variable-length load-bearing leg as described above. The variable-length leg, equipped with its own movable base, can be connected to the upper end of the fixed-length boom adjacent the boom crown blocks. Such an arrangement can very substantially increase the load-radius characteristics of a conventional side-lift tractor.

It will also be apparent that leg base units other than track-laying tractors or crawlers can be used if desired. The leg base units can be simple sled-like structures moved from place to place by skidding. Also, the base units can be wheeled, preferably self-propelled, units which can be similar to heavy-duty wheeled construction tractors, if desired.

The mechanisms used to power the variable-length leg assemblies to alter the effective lengths thereof under loads need not be hydraulic mechanisms. The leg drive mechanisms can be electro-mechanical in nature, such as screw jacks operated by electric motors, for example.

Persons skilled in the art to which this invention pertains will appreciate that the preceding description of this invention has been presented with reference to selected illustrated embodiments of the invention, including the presently preferred embodiment. It will be understood, however, that the present description can be manifested in embodiments different from the embodiments described above and shown in the drawings. Thus, the preceding description sets forth the presently known best mode of practicing this invention, but certainly not all possible modes. Workers skilled in the art will readily appreciate that modifications, alterations, or variations in the structural arrangements and procedures described may be practiced without departing from, and while still relying upon, the essential aspects of this invention.

What is claimed is:

1. Apparatus useful in rough terrain for lifting and moving heavy loads comprising (a) at least three leg assemblies at least one of which is arranged for controlled variation of the length thereof while subjected to axial loading of the leg, (b) power means associated with each variable-length leg assembly selectively operable for varying the length of the associated leg assembly under axial load thereof, (c) a base unit for each leg assembly, each base unit including means cooperable with a lower end of a leg assembly for pivotally connecting the leg assembly to the base unit, (d) a crown block assembly including means cooperable with an upper end of each of the leg assemblies for pivotally connecting the leg assemblies thereto, and (e) winch means associated with one of the leg assemblies operable for reeling in and out a cable extendible therefrom via the crown block assembly to a load for lifting and lowering the load in an assembled state of the apparatus, (f) whereby variation of the length of at least one of the leg assemblies while a load is suspended from the crown block produces controlled lateral movement of the crown block and resulting movement of the load within the area bounded by the base units and without movement of the base units.

2. Apparatus according to claim 1 wherein the base units are self-propelled.

3. Apparatus according to claim 2 wherein the base units are steerable.

4. Apparatus according to claim 3 wherein the base units are of the track laying type.

5. Apparatus according to claim 1 wherein the apparatus consists of three leg assemblies.

6. Apparatus according to claim 5 wherein each leg assembly is arranged for controlled variation of the length thereof.

7. Apparatus according to any one of claims 1, 5, or 6 wherein the power means is a hydraulic mechanism.

8. Apparatus according to claim 7 wherein each variable-length leg assembly comprises a telescoping hydraulically operated mechanism.

9. Apparatus according to claim 1 including inextensible tension means operatively connectible between the leg assemblies for restraining the lower ends thereof from movement relative to each other in an assembled state of the apparatus during lifting of the load.

10. Apparatus according to claim 9 wherein the tension means comprises cables.

11. Apparatus according to claim 10 including means for adjusting the effective length of each of the cables.

12. Apparatus according to claim 11 wherein the cable length adjusting means comprises a winch mounted to each of the base units, each winch having at least one of the cables connected thereto.

13. Apparatus according to claim 1 wherein the assembled state of the apparatus is a state in which the leg assemblies are connected to the base units and to the crown block assembly, in which the base units can be disposed in spaced relation about the load, and in which a lifted load is movable laterally within an area bounded by the base units by variation in the lengths of the variable-length leg assemblies.

14. A method of lifting heavy loads and moving the same short distances comprising the steps of (a) identifying first and second locations at which a load is to be picked up and is to be set down, respectively, (b) placing at each of three spaced stations, defining the points of a triangular area within which said locations lie, the lower end of a respective one of three elongate load-carrying leg assemblies, at least one of the leg assemblies being capable of variation of the length thereof while subjected to axial load, the leg assemblies being pivotally interconnected at their upper ends, (c) adjusting the lengths of at least one of the variable-length leg assemblies to cause the upper ends of the leg assemblies to occupy a first position substantially over the first location, (d) connecting a lift mechanism between the upper ends of the leg assemblies and the load and operating the lift mechanism to lift the load from the first location to a suspended position, (e) varying the length of at least one of the variable-length leg assemblies in such manner and relation to each other, while the load is suspended by the lift mechanism, and without movement of the lower ends of the leg assemblies from said stations, to cause the upper ends of the assemblies to move from the first position to a second position substantially over the second location, and (f) operating the lift mechanism while the upper ends of the leg assemblies are in their second position to set the load down at the second location.

15. The method according to claim 14 including supporting the lower end of each leg assembly on a base unit to which the leg assembly is movably connected.

16. The method according to claim 15 wherein each base unit is capable of self-propulsion.

17. The method according to claim 16 including controlling the movement of all base units from one of the base units.

18. The method according to claim 14 including interconnecting the lower ends of the leg assemblies as placed at said stations by taut inextensible tension means sufficient to restrain the leg assembly lower ends from moving relatively apart while the load is suspended by the lift mechanism.

19. The method according to claim 18 including restraining the lower ends of the leg assemblies from moving relatively apart while the load is suspended by the lift mechanism.

* * * * *